US005525067A

United States Patent [19]

Gatti

[11] Patent Number: 5,525,067

[45] Date of Patent: Jun. 11, 1996

[54] GROUND PLANE INTERCONNECTION SYSTEM USING MULTIPLE CONNECTOR CONTACTS

[75] Inventor: John E. Gatti, Scottsdale, Ariz.

[73] Assignee: Motorola, Inc, Schaumburg, Ill.

[21] Appl. No.: 190,957

[22] Filed: Feb. 3, 1994

[51] Int. Cl.[6] ..... H01R 9/24

[52] U.S. Cl. ..... 439/108

[58] Field of Search ..... 439/620, 65, 101, 439/108, 499, 79

[56] References Cited

U.S. PATENT DOCUMENTS 4,157,612 6/1979 Rainal ..... 439/497 X 5,026,292 6/1991 Pickles et al. ..... 439/108

5,040,999 8/1991 Collier ..... 439/108

5,051,099 9/1991 Pickles et al. ..... 439/108

5,224,867 7/1993 Ohtsuki et al. ..... 439/108

*Primary Examiner*—Kenneth J. Ramsey

*Attorney, Agent, or Firm*—Harold C. McGurk, IV; S. Kevin Pickens

[57] ABSTRACT

A ground plane interconnection system using multiple connector contacts interconnects ground planes between backplanes, between circuit boards or between backplanes and circuit boards. When a column or a portion of the column of contacts is allocated to the ground plane interconnect, the ground plane interconnects within the acceptable operational impedance range. These contacts behave as a plane in the direction of interest in a backplane system.

5 Claims, 10 Drawing Sheets

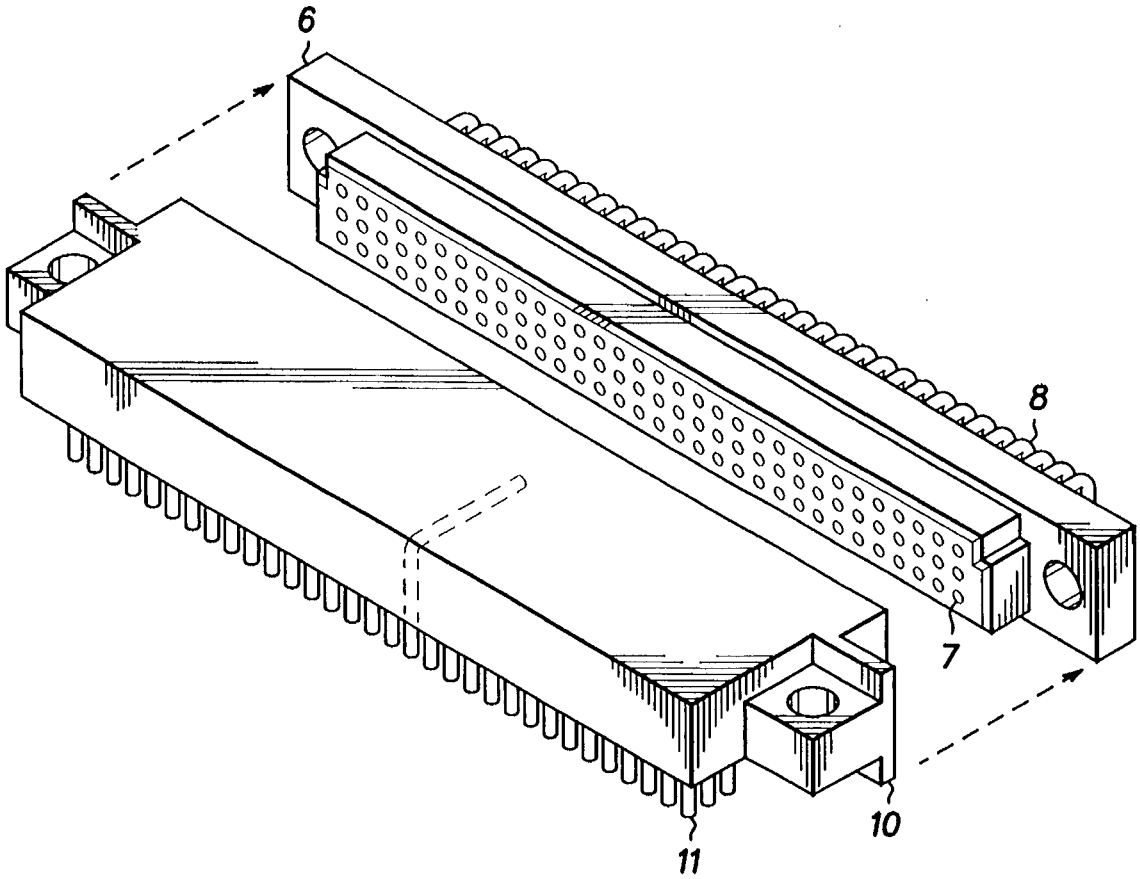
5 FIG. 1
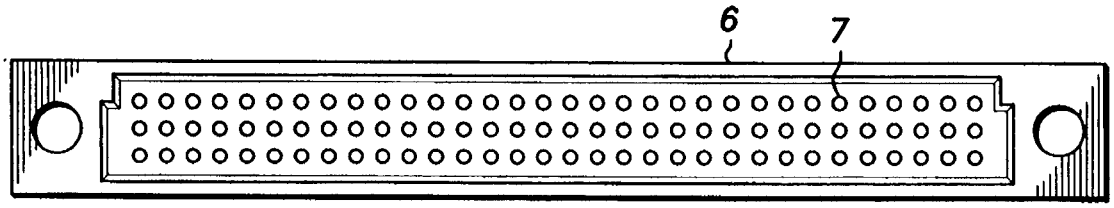
FIG. 2

GROUND PLANE INTERCONNECTION SYSTEM USING MULTIPLE CONNECTOR CONTACTS

TECHNICAL FIELD

This invention relates generally to systems for interconnecting ground planes and, in particular, to a ground plane interconnection system which uses multiple connector contacts to interconnect ground planes between backplanes, between circuit boards or between backplanes and circuit boards.

BACKGROUND OF THE INVENTION

A "ground plane" is commonly defined as a conductive layer in a circuit board that is electrically contiguous in its X and Y dimensions relative to signal conductors in adjacent layers of the circuit boards. The signal conductors can be viewed as lines drawn over and under the plane of the ground plane. Among other function (e.g., distribution of DC power), the ground plane provides a low impedance path for return currents of signals and for shielding.

A "backplane" as commonly defined is an assembly that provides interconnection functions for a plurality of separate electronic modules (e.g., circuit boards or daughter cards) that connect to it. In some products such as the Series 900, a backplane may be expandable by the addition of modules or sections. This requires the interconnection of conductors in the separate modules to pass signals between modules as if the separate modules were part of one large backplane. The interconnection can be accomplished by using commonly available connectors.

Most electronic busses require that there be a ground plane in the backplane. When separate modules are connected together, it is important to also interconnect the ground plane between the modules. While a signal conductor on a backplane has a significant impedance of about 75 ohms, the ground plane requires an impedance of 0.1 ohms or lower to operate properly. Signal carrying conductors are often specified in ohms of impedance at a signal frequency of interest, and is implied to be uni-directional along the conductors length. Ground planes are specified in ohms of impedance per square at a frequency of interest, and is omni-directional in the plane. Although ground planes are omni-directional conductors, the impedance of an interconnection between ground planes can be considered as uni-directional (in the direction of the interconnection).

If ground planes on separate modules are connected with impedances above 0.1 ohms, signal return currents between the ground planes can develop voltages across the ground plane interconnection that may result in the system failure. The characteristic impedance of the contact system used in connectors and the characteristic impedance of the signal conductors in the backplane have to be matched so that signals pass through the connector with minimal signal degradation. Impedance in contacts systems usually range from 30 ohms to 150 ohms, where 75 ohms is approximately the average impedance.

Some conventional ground plane interconnection systems use continuous conductor strips to connect ground planes together. The continuous conductor strips are usually made of some type of metal, such as copper, for example. The impedance of the continuous conductor strips is within the operational impedance range from near 0 to 0.1 ohms. However, continuous conductor strips add significantly to the cost of the connector and to the size and complexity of the mechanical connections. Accordingly, there is a significant need to connect two ground backplanes together without requiring any external mechanical device or continuous conductor strips other than using a regular connector and that operates within the acceptable impedance range.

SUMMARY OF THE INVENTION

The present invention has utility in using multiple connector contacts to interconnect ground planes between backplanes, between circuit boards or between backplanes and circuit boards. Connector contacts are commonly arranged in a closely spaced grid pattern. When a column of the pattern contacts is allocated to the ground plane interconnect without intervening signal contacts, the ground plane interconnects within the acceptable operational impedance range. These contacts do not behave as separate contacts operating electrically in parallel; but, because their adjacency define a plane, they behave as a single conductive plane in the direction of interest in the backplane system.

The physics that explains this invention concerns the electromagnetic field that develops around a multiplicity of conductors that are carrying current in the same direction. The developing electromagnetic field surrounds all of the separate conductors as if they were one wide conductor. The dimensions of this field directly relate to the impedance of the conductor. A wide conductor takes on properties that are not like those of a normal signal conductor.

Thus it is an advantage of the present invention to interconnect ground planes using a column of contacts which has a near zero impedance.

It is also an advantage of the present invention to simplify the design of the ground plane interconnection.

It is another advantage of the present invention to allow a ground plane interconnection that can be made to work at any frequency of interest.

Yet another advantage of the present invention is to increase the reliability of the ground plane interconnect.

According to one aspect of the invention, a ground plane interconnection system comprises: a first circuit board having a ground plane and including a first connector, the first connector comprising a plurality of first contacts; a second circuit board having a ground plane and including a second connector, the second connector comprising a plurality of second contacts; the first and second contacts coupled to each other; a plurality of the coupled contacts which are physically adjacent to each other forming a column of coupled contacts; the column of coupled contacts connecting to the ground planes of the circuit boards; the length of the column of coupled contacts being greater than the length of a conductor path formed by one of the coupled contacts.

BRIEF DESCRIPTION OF THE DRAWINGS

FIG. 1 shows a connector in accordance with a preferred embodiment of the present invention;

FIG. 2 shows a front view of a receptacle part of a connector in accordance with a preferred embodiment of the present invention;

DESCRIPTION OF THE PREFERRED EMBODIMENTS

Figure 3:
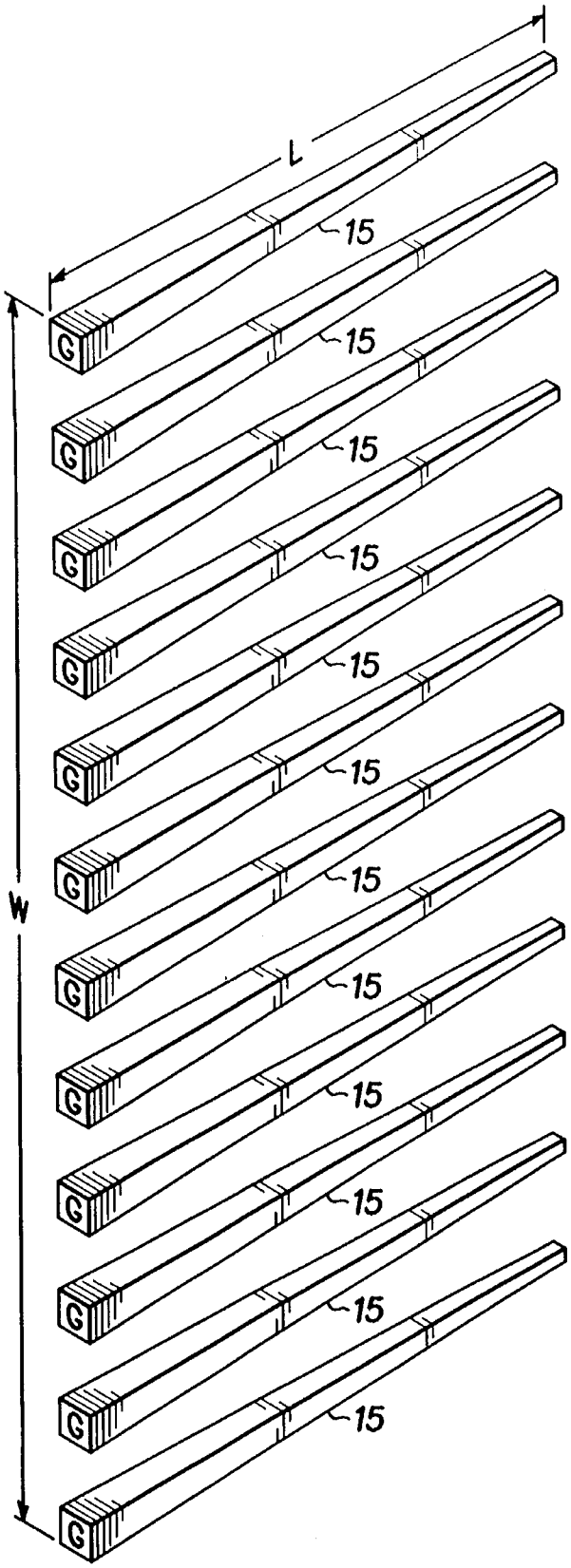
FIG. 3 shows a pattern of connector contacts for forming a ground plane interconnection in accordance with a preferred embodiment of the present invention.

FIG. 1 shows connector 5 in accordance with a preferred embodiment of the present invention. As shown in FIG. 1, connector 5 has three columns of 32 contacts each. Connector 5 comprises a receptacle section 6 and pin section 10. Contact holes 7 in receptacle section 6 fit into or attach to contacts or pins (not shown) of pin section 10. Pins 8 of receptacle section 6 connect to or are inserted into corresponding holes in a backplane (not shown). Similarly, pins 11 of pin section 10 connect to or are inserted into corresponding holes of another circuit board (not shown). The backplane may be an S900 backplane, commercially available from Motorola, Inc., or may be another type of backplane. The circuit boards may be VME197 circuit boards which are also commercially available from Motorola, Inc.

Pin section 10 of connector 5 provides a 90 degree bend in the conductors that make up the contacts. This bend results in a 90 degree bend in the ground plane when it interconnects the backplane to the circuit board. Although the 90 degree bend in not necessary, it is included to illustrate the flexibility of the invention. In other words, whether there is or is not a bend in the ground plane, the ground planes will still successfully interconnect.

The spacing of the individual contacts and the insulating materials used between the contacts affects the maximum frequency that can be used before the impedance of the interconnection rises above a useful value. Common connector contact spacing, typically less than 0.2 inches, provides impedances that meet the requirement of the ground plane interconnection.

FIG. 2 shows a front view of receptacle section 6 of connector 5 in accordance with a preferred embodiment of the present invention. As shown in FIG. 2, there are three columns of 32 contact holes 7. All or a portion of one of the columns of contacts is used to interconnect two ground planes together.

FIG. 3 shows a pattern of connector contacts 15 for interconnecting two ground planes together in accordance with a preferred embodiment of the present invention. A signal conductor, in connectors and circuit boards are many times longer than wide. Therefore, they have impedances in the range of 10 to 300 ohms with typical values near 75 ohms.

As shown in FIG. 3, no signals other than ground are present. To achieve a low impedance connection, the length "L" of contact interconnection 15 in the connectors, must be shorter than the width, "W", of the column of contacts. The preferred embodiment for achieving substantially zero impedance is 3L=W. A conductive path that is wider than it is long behaves as a conductive plane. Thus, the ground plane is interconnected among the circuit boards and backplanes. This allows the return path for common mode signals that does not develop a voltage across the interconnection that will disturb the transmission.

The cumulative impedance of the connector contacts is near zero. The idea of interconnecting the ground planes on separate sections of a backplane system does not naturally lead to an implementation utilizing a connector system that utilizes contacts with significant impedance. This is because if a connector system chosen for the signals typically has an impedance of 75 ohms per contact, and if those contacts were also used to interconnect the ground planes, the electrically parallel operation of a large number of those contacts would not appear to yield a sufficiently low impedance. Using a lower impedance connector at 50 ohms per contact only helps marginally. For example, 100 such contacts in parallel yield an interconnection impedance of 0.5 ohms, which is too high for proper operation of many busses. Moreover, 200 contacts in parallel yield an interconnection impedance of 0.25 ohms which is still greater than the required interconnection impedance of 0.1 ohms or less.

In addition, parallel contacts are separated by significant physical space along the interconnection. In small regions of this space, where the impedance needs to be approximately equal to zero, only those contacts in the immediate region can be considered as parallel conductors for the ground plane. Thus, the total or effective impedance in that region is too large.

When contacts 15 are used to connect signals to each other, some conventional systems surrounded the signal contacts with contacts connected to the ground plane. Although such a configuration is used to isolate the active signals so that cross-talk between the active signals is virtually eliminated, this configuration does not create a ground plane interconnection. Contacts connected to ground plane have the same characteristic impedance as signal contacts when they are isolated from other contacts connected to ground by any intervening contacts that are connected to signals. Therefore, isolated contacts connected to the ground plane do not create a ground plane between circuit boards.

Figure 4:
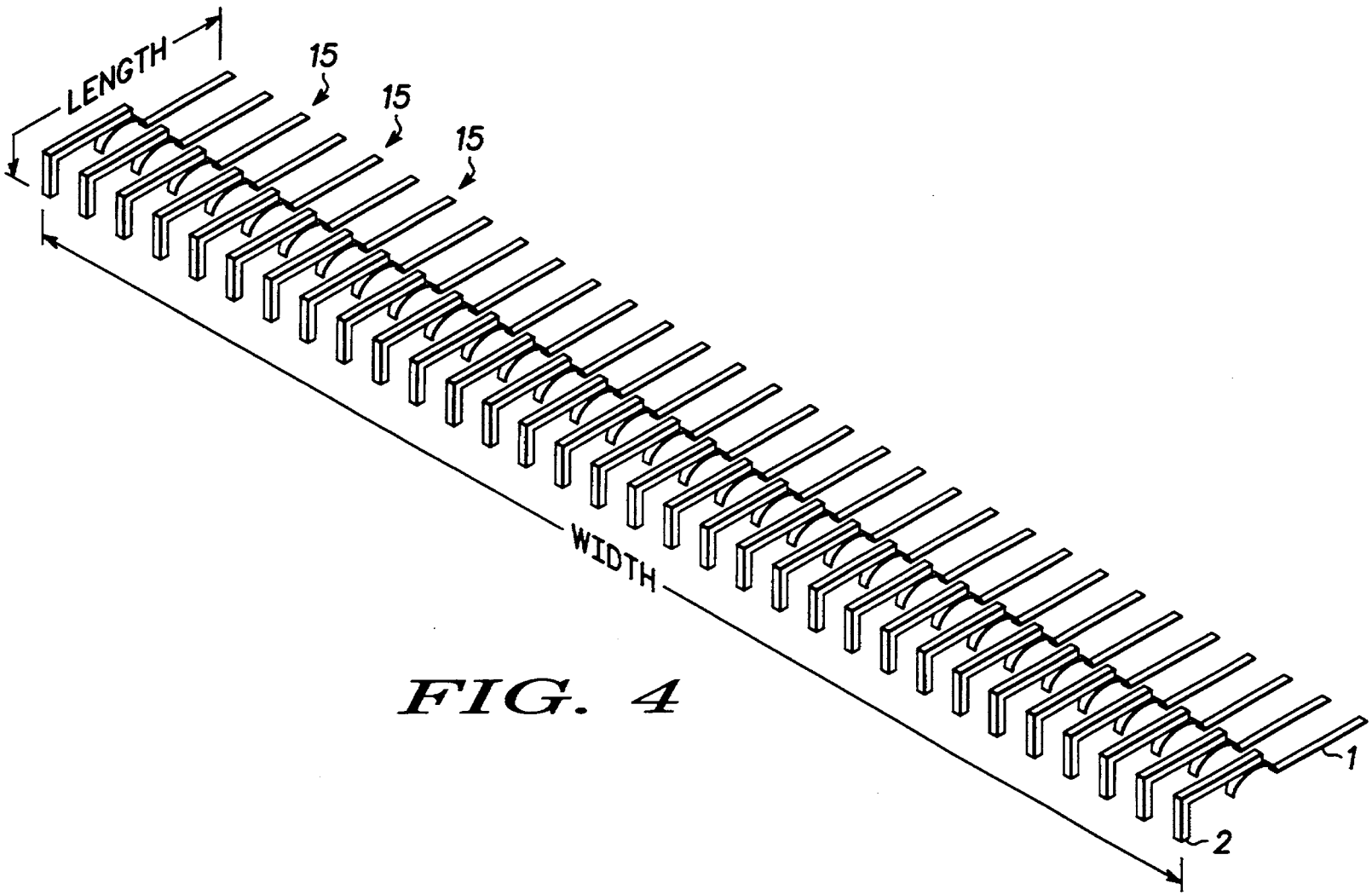
FIG. 4 shows a view of connected contacts showing the length of the conductive path and the direction along which the width of the column is measured in accordance with a preferred embodiment of the present invention.

FIG. 4 shows a column of adjacent contacts 15 from a connector system. The "length" of the conducting path of one pair of contacts 15 must be shorter than the "width" of the column of contacts so that there is a significant reduction in interconnection impedance. At a width greater than the length, the low impedance is substantially due to the particular physical arrangement of the contacts rather than due to the electrically parallel sum of the contacts.

Figure 5:
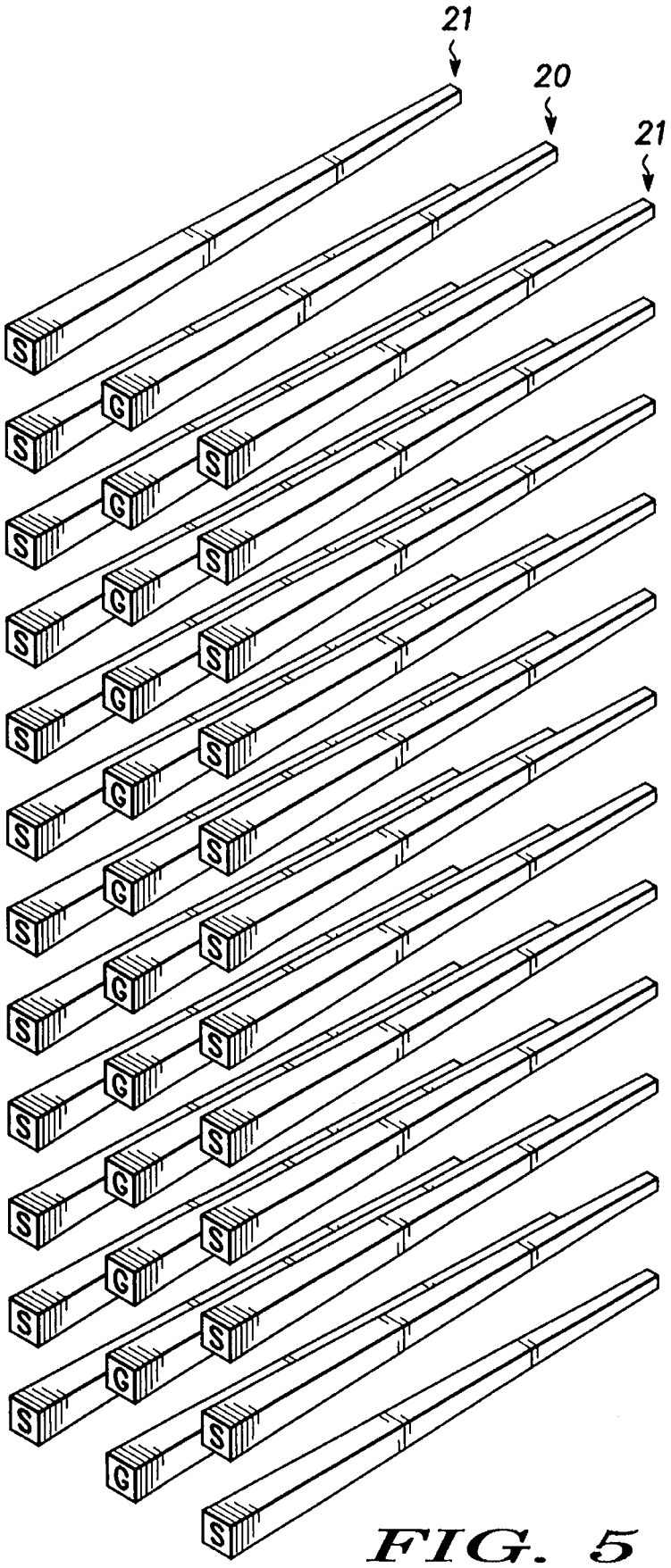
FIGS. 5–10 show alternative arrangements of the signal and ground plane contacts in accordance with preferred embodiments of the present invention.

FIGS. 5–11 show alternative arrangements of the contacts in accordance with preferred embodiments of the present invention. FIG. 5 shows a column 20 of contacts connected to a ground plane between two columns 21 of other contacts for signals. Column 20 forms a ground plane interconnection when the length of the column of contacts is about three times less than the width of the column of contacts.

Figure 6:
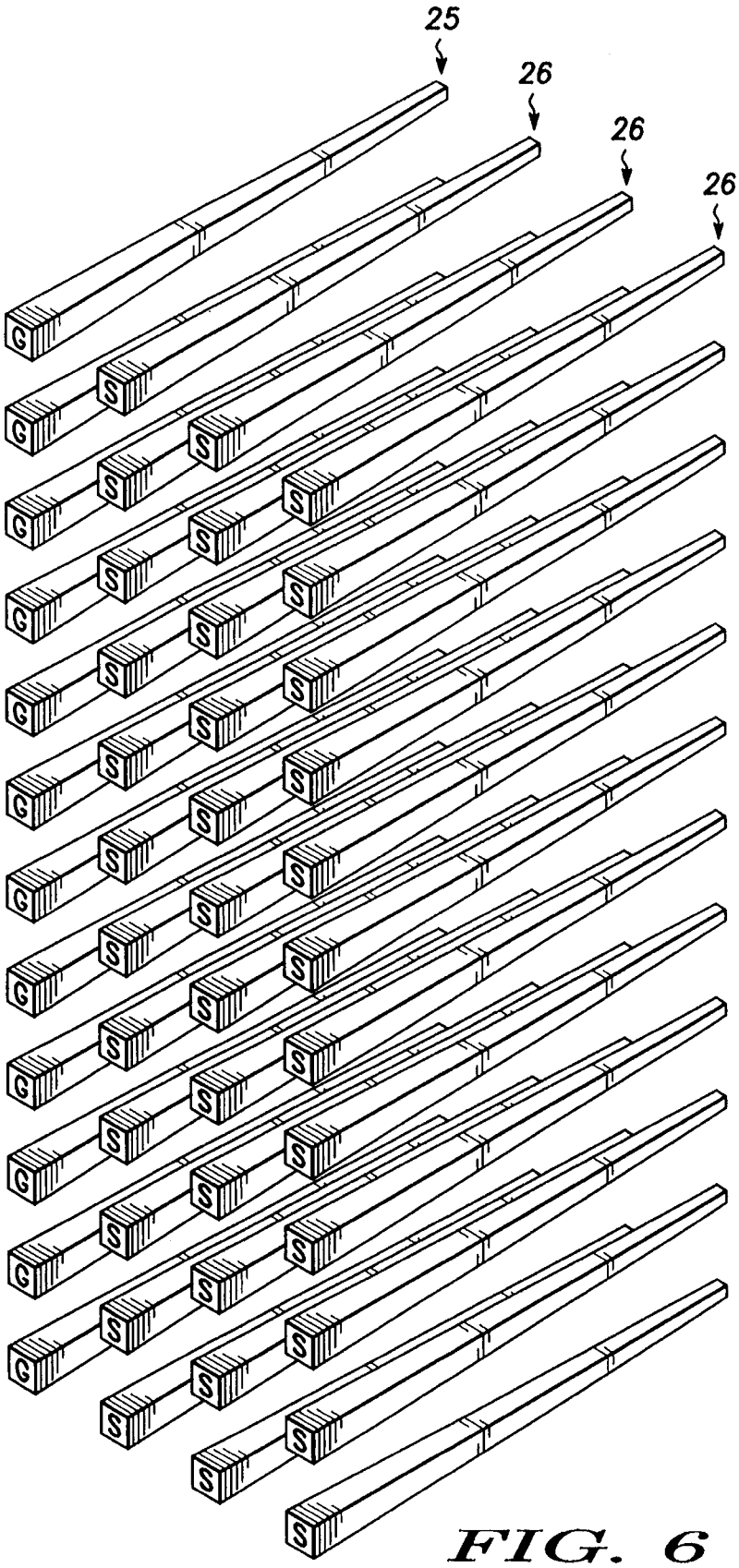

FIG. 6 shows a column 25 of contacts connected to a ground plane at the end of three columns 26 of contacts for signals. Column 25 forms a ground plane interconnection.

Figure 7:
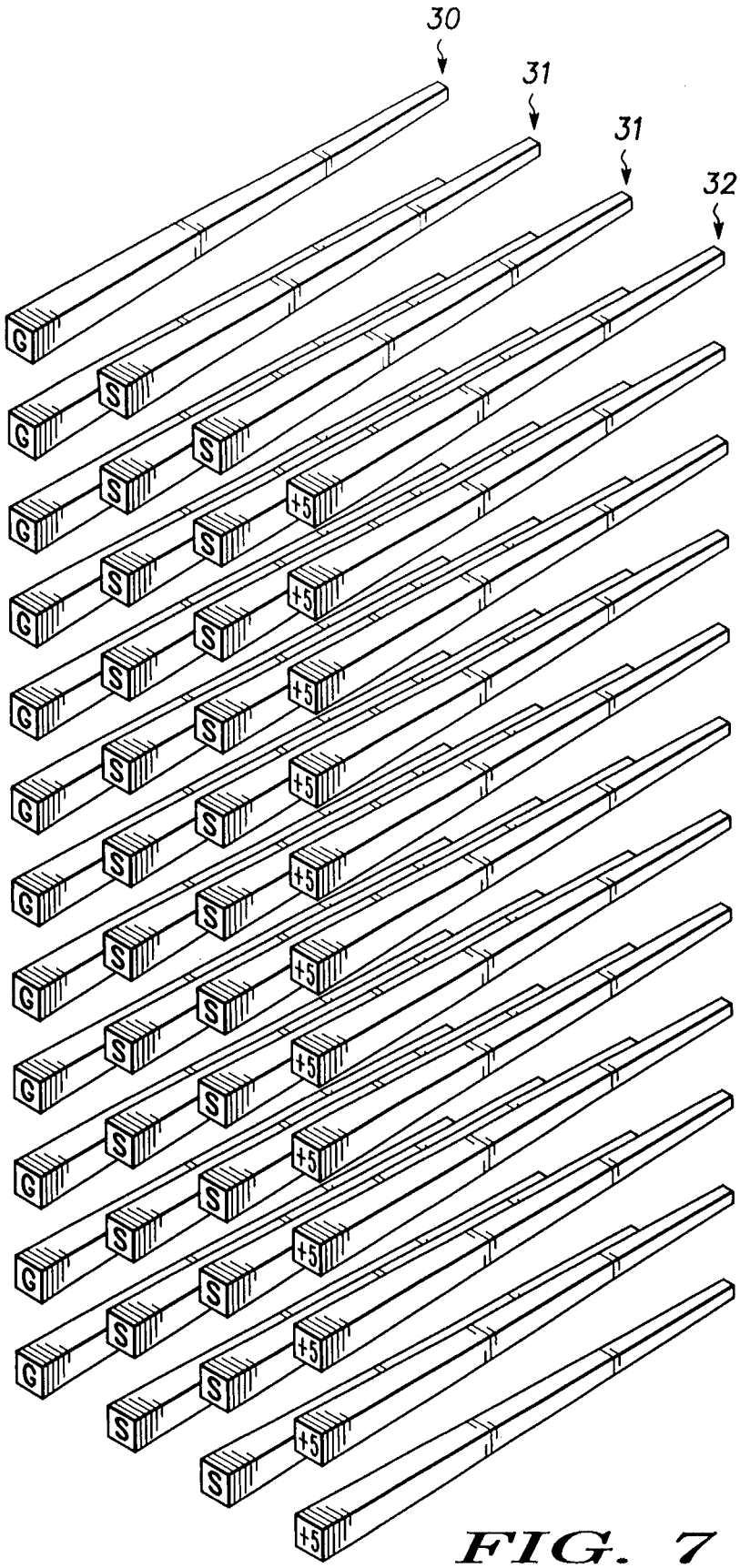

FIG. 7 shows a column 30 of contacts connected to ground, two columns 31 signals and a column 32 of contacts connected to +5 volts D.C. supply plane. The +5 volts supply plane is a signal return path and is therefore, a ground plane. The column 30 of grounded signals and column 32 of +5 voltage D.C. signals each create a ground plane interconnection: one ground plane interconnecting ground while the other carrying +5 voltage D.C., respectively.

Figure 8:
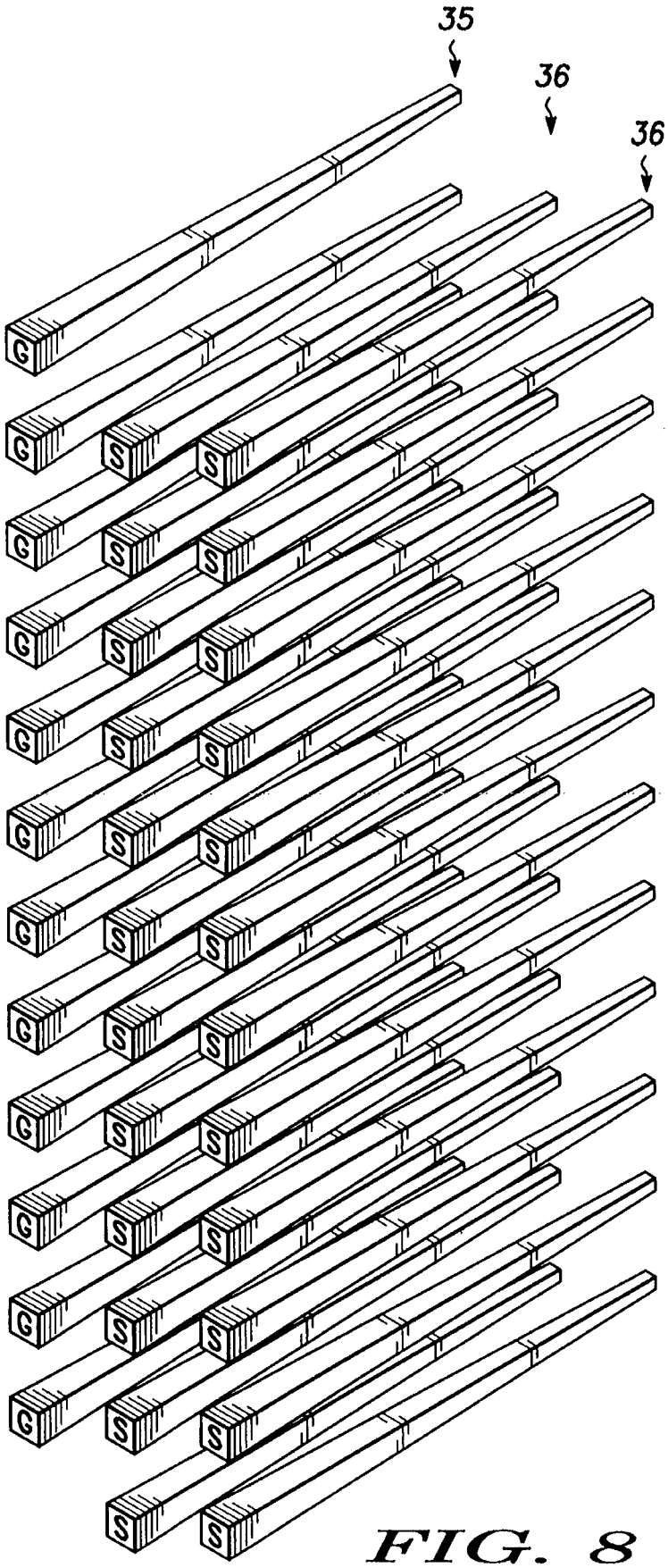

FIG. 8 shows a column 35 of contacts connected to ground at the end of columns 36 of contacts for other signals. As shown in FIG. 8, some connectors have staggered patterns of conductors, but the ground plane interconnection formed by column 35 of contacts connected to ground is not affected.

Figure 9:
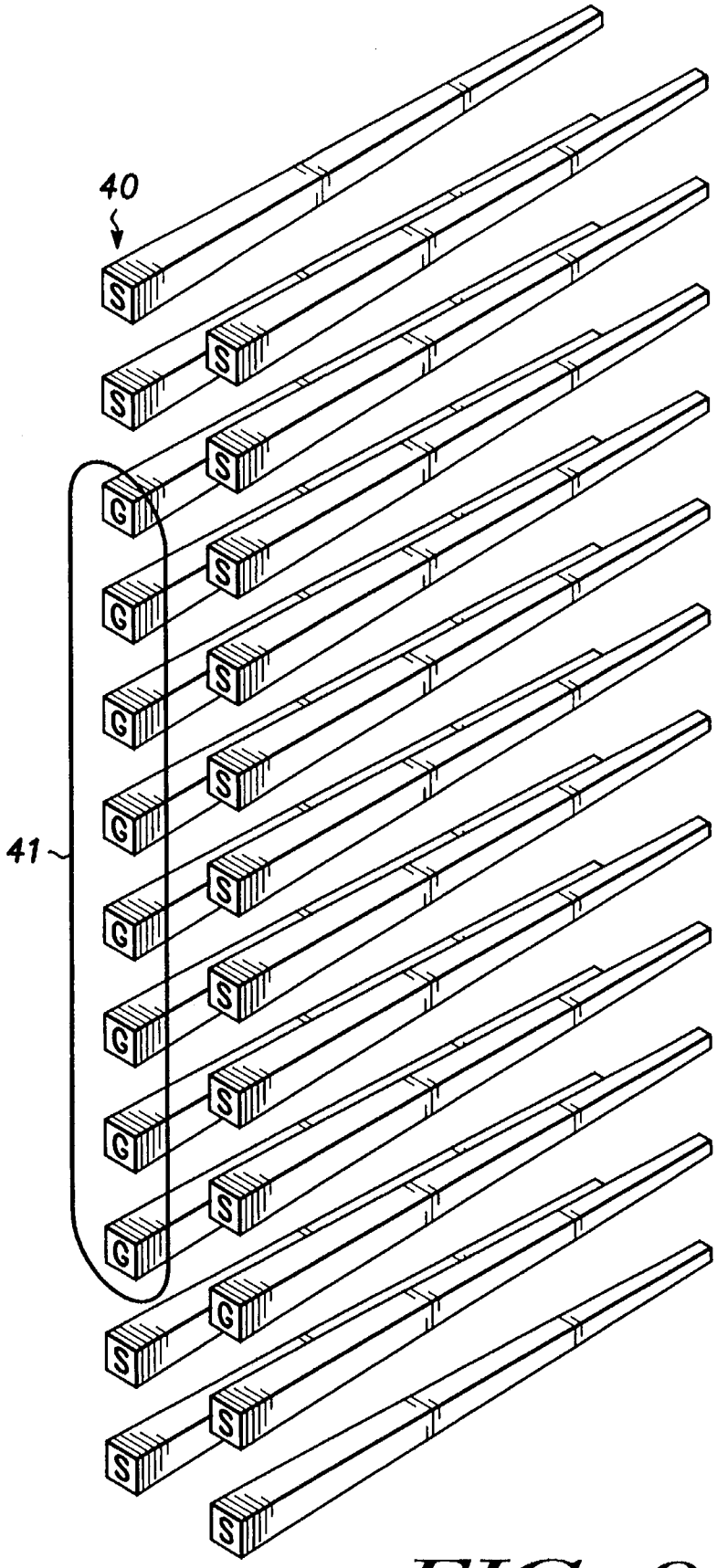

FIG. 9 shows that all of the contacts or pins in a column 40 do not have to be grounded. If the contacts connected to ground enclosed by circle 41 make a wide enough path for the low impedance (i.e., width>length), a ground plane interconnection is formed.

Figure 10:
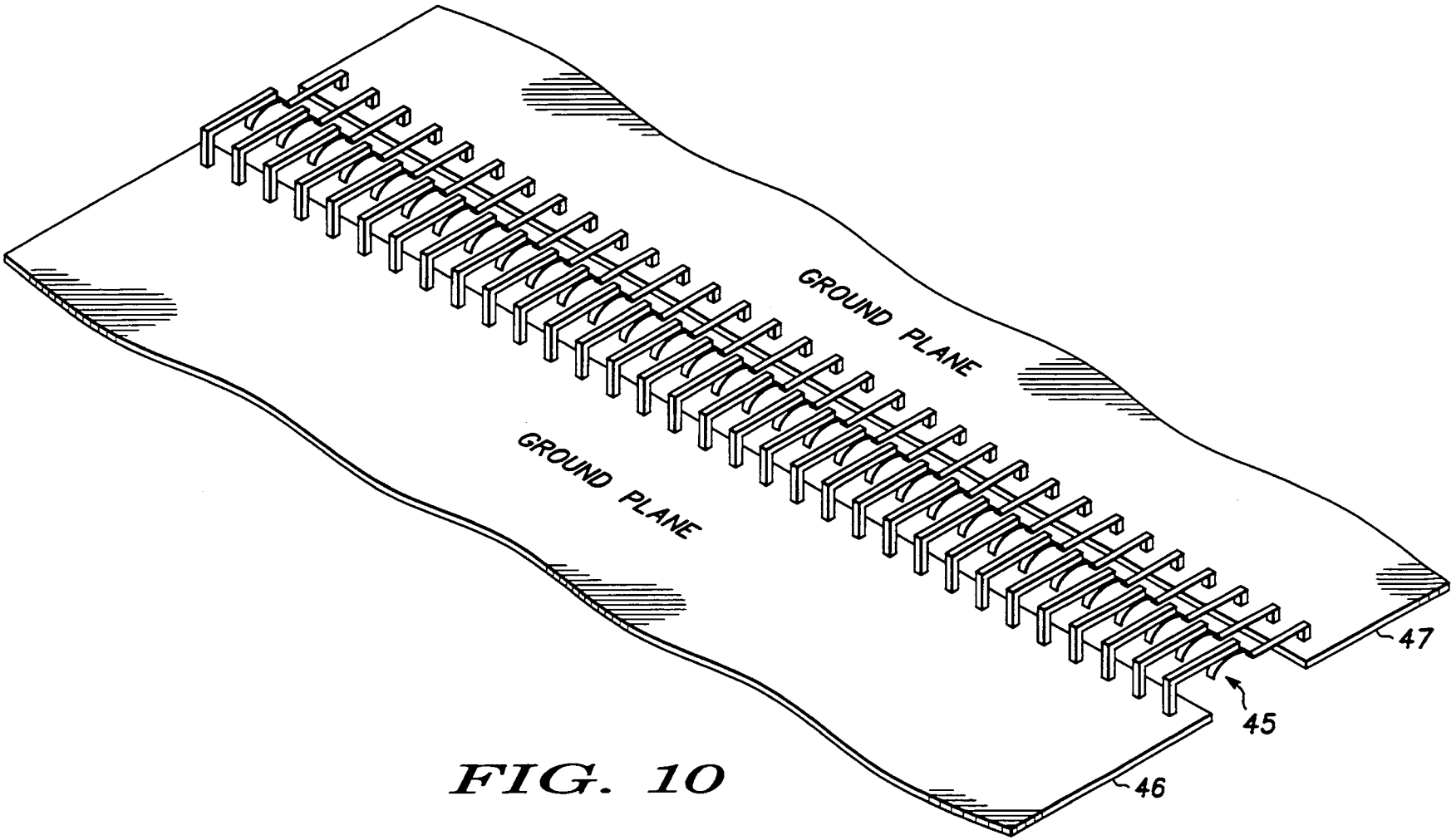
Figure 11:
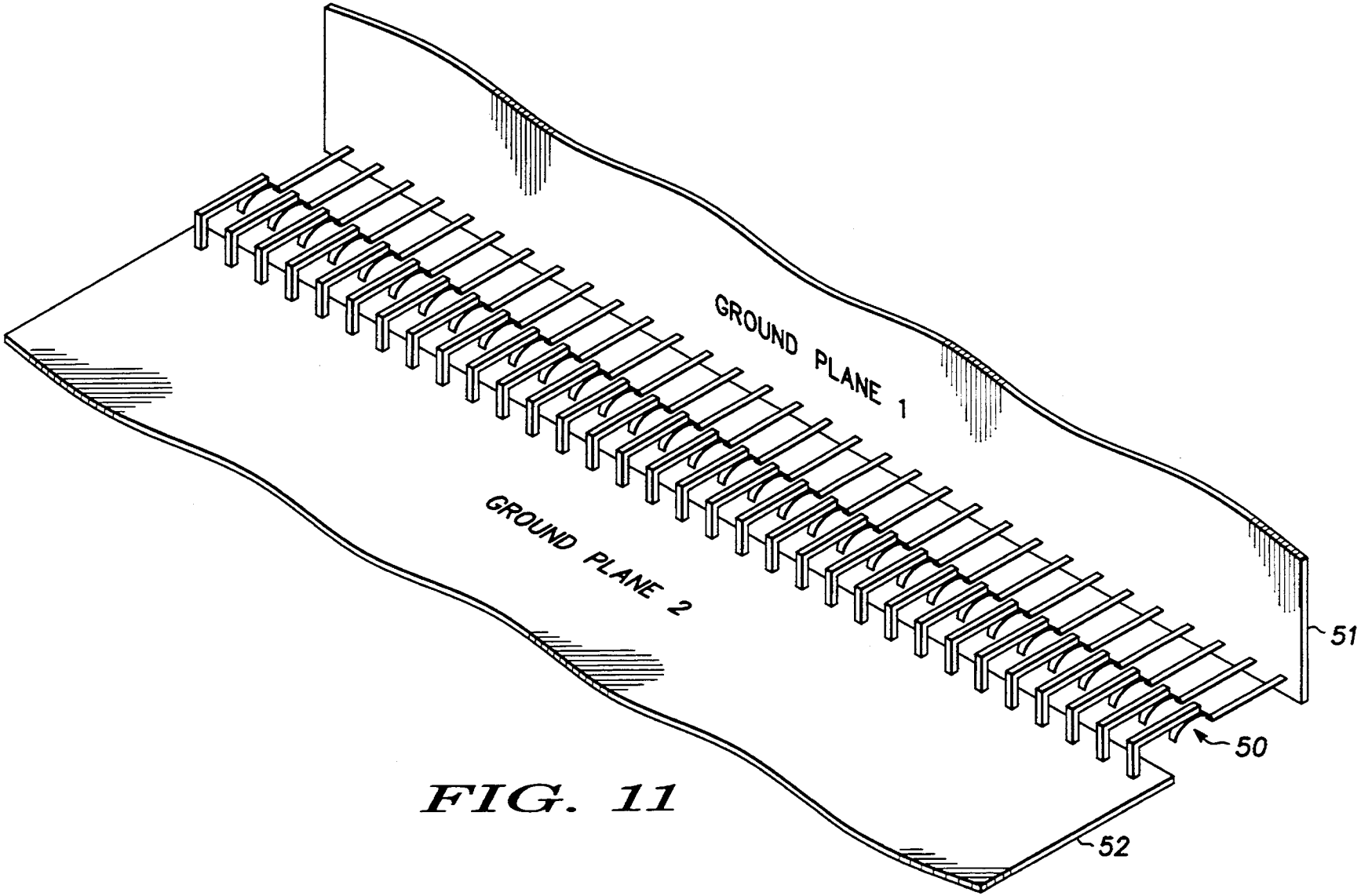
FIG. 11 shows a view the contacts connecting two ground planes in accordance with a preferred embodiment of the present invention.

FIG. 10 shows connector contacts 45 interconnecting two ground planes 46, 47. Note that the conductor path is not always in the geometric plane of the ground planes. The conductors 45 in the connector only have to run adjacently to work. FIG. 11, similar to FIG. 10, shows that a ground plane interconnection using contacts 50 also exists between two right angle ground planes 51, 52. The contacts used for signals are omitted in FIG. 10 and 11.

It will be appreciated by those skilled in the art that the present invention arranges contacts in such a manner as to interconnect ground planes. The multiple contacts are adjacent to one another without any intervening signal contacts. The fields that develop in the arrangement of contacts, due to the conduction of electric currents between the planes connected by these contacts, function as if the separate contacts are one wide conductor. Accordingly, it is intended by the appended claims to cover all modifications of the invention which fall within the true spirit and scope of the invention.

What is claimed is:

1. A ground plane interconnection system comprising:

a first circuit board having a ground plane and including a plurality of first contacts;

a second circuit board having a ground plane and including a plurality of second contacts;

the first and second contacts coupled to each other;

a plurality of the coupled contacts which are physically adjacent to each other forming a column of coupled contacts;

the column of coupled contacts connecting to the ground planes of the circuit boards;

the length of the column of coupled contacts being greater than the length of a conductor path formed by one of the coupled contacts.

2. A ground plane interconnection system comprising:

a first circuit board having a ground plane and including a receptacle connector, the receptacle connector comprising a plurality of first contacts;

a second circuit board having a ground plane and including a pin connector, the pin connector comprising a plurality of second contacts;

the first and second contacts coupled to each other;

a plurality of the coupled contacts which are physically adjacent to each other forming a column of coupled contacts;

the column of coupled contacts connecting to the ground planes of the circuit boards;

the length of the column of coupled contacts being greater than the length of a conductor path formed by one of the coupled contacts.

3. A ground plane interconnection system as recited in claim 2, wherein the first and second circuit boards each having a second ground plane and wherein the coupled contacts interconnect the second ground plane between the first and second circuit boards.

4. A ground plane interconnection system comprising:

a plurality of circuit boards each having at least one ground plane and comprising a plurality of contacts;

the contacts of each circuit board coupled to the contacts of another circuit board;

for each of the circuit boards coupled together a plurality of the coupled contacts which are physically adjacent to each other forming a column of coupled contacts;

the column of coupled contacts connecting to the corresponding ground planes of the circuit boards;

the length of the column of coupled contacts is greater than the length of a conductor path formed by one of the coupled contacts.

5. A ground plane interconnection system comprising:

a backplane having a ground plane and including a plurality of first contacts;

a circuit board having a ground plane and including a plurality of second contacts;

the first and second contacts coupled to each other;

a plurality of the coupled contacts which are physically adjacent to each other forming a column of coupled contacts;

the column of coupled contacts connecting to the ground planes of the backplane and the circuit board;

the length of the column of coupled contacts being greater than the length of a conductor path formed by one of the coupled contacts.

* * * * *